United States Patent [19]

Inoue et al.

[11] Patent Number: 4,697,119

[45] Date of Patent: Sep. 29, 1987

[54] COLOR CATHODE RAY TUBE HAVING A NON-SPHERICAL CURVED MASK

[75] Inventors: Masatsugu Inoue; Hidetoshi Yamazaki, both of Fukaya, Japan

[73] Assignee: Kabushiki Kaisha Toshiba, Kawasaki, Japan

[21] Appl. No.: 815,023

[22] Filed: Dec. 31, 1985

[30] Foreign Application Priority Data

Jan. 11, 1985 [JP] Japan ..... 60-2040
Nov. 25, 1985 [JP] Japan ..... 60-262375

[51] Int. Cl.[4] ..... H01J 29/07
[52] U.S. Cl. ..... 313/408; 313/402
[58] Field of Search ..... 313/402, 408, 403

[56] References Cited

U.S. PATENT DOCUMENTS

| | | | |
|---|---|---|---|
| 3,435,268 | 3/1969 | Rublack | 313/408 |
| 3,889,145 | 6/1975 | Suzuki et al. | 313/408 |
| 3,925,700 | 12/1975 | Saito | 313/403 |
| 3,947,718 | 3/1976 | Van Lent | 313/408 |
| 4,136,300 | 1/1979 | Morrell | 313/403 |
| 4,162,421 | 7/1979 | Morrell | 313/403 |
| 4,173,729 | 11/1979 | Stone et al. | 313/403 |

FOREIGN PATENT DOCUMENTS

| | | | |
|---|---|---|---|
| 1589841 | 5/1982 | Fed. Rep. of Germany | 313/408 |
| 212357 | 8/1984 | Fed. Rep. of Germany . | |
| 52-49764 | 4/1977 | Japan | 313/403 |
| 54-49062 | 4/1979 | Japan | 313/402 |
| 103239 | 6/1982 | Japan | 313/402 |
| 59-75539 | 4/1984 | Japan | 313/403 |
| 59-163737 | 9/1984 | Japan . | |
| 59-165341 | 9/1984 | Japan | 313/402 |
| 60-9035 | 1/1985 | Japan . | |
| 39740 | 3/1985 | Japan | 313/402 |
| 60-177534 | 9/1985 | Japan . | |

*Primary Examiner*—David K. Moore
*Assistant Examiner*—K. Wieder
*Attorney, Agent, or Firm*—Oblon, Fisher, Spivak, McClelland & Maier

[57] ABSTRACT

The shadow mask of a color cathode ray tube has a number of apertures in the effective area passed by electron beams to the phosphor screen formed in the inner surface of the panel. The effective area where these apertures are distributed is in the nonspherical configuration adjacent to the phosphor screen surface. When taking the major axis as the X axis, the minor axis as the Y axis and the center of the shadow mask through where the tube axis (the Z axis) passes is made as a point of origin, the line of intersection defined by the plane containing the X axis and Z axis (X-Z plane) and the effective area is formed by the curve positioned as the panel side other than three points of which the circular arc passes in common through both terminal points and the center point on the above line of intersection, against the circular arc.

7 Claims, 11 Drawing Figures

COLOR CATHODE RAY TUBE HAVING A NON-SPHERICAL CURVED MASK

BACKGROUND OF THE INVENTION

The present invention relates to a shadow mask type color cathode ray tube and more particularly to a curved shape therein.

A shadow mask employed in a shadow mask type color cathode ray or picture tube is an important element possessing a color selection function. In more detail, a shadow mask constituted by an effective surface portion that has a substantially rectangular area and has formed therein a large number of apertures in a regular array is provided at a set distance from a curved panel inner surface that has a substantially rectangular area and has applied thereon a phosphor screen of individual phosphors for emitting a number of colors. A plurality of electron beams from electron guns provided in the neck portion of the tube are focussed and accelerated and are subjected to a deflection action cause them to scan a substantially rectangular area and to pass through the shadow mask apertures to strike and cause emission of light by corresponding phosphors and thereby produce an image. In order to ensure so-called beam landing between the set of shadow mask apertures and the set of corresponding phosphors, it is necessary that they be in a specific relative positional relation, which has to be remained constant during operation of the cathode ray tube. More specially, the interval between the shadow mask and the phosphor surface (referred to as the q value below) must always be within a set permissible range. However, from the principle of operation of a shadow mask type color cathode ray tube, only one third or less of the electron beams pass through the shadow mask and the remainder strike portions of the shadow mask where there are no apertures, the beam energy are converted to thermal energy and heat and cause expansion (referred to below as doming) of the mask. Consequently, if the position of the shadow mask, which is generally made of metal having iron as its main component, changes to the extent that the q value is outside the permissible range because of heating and expansion, the result is deterioration of the color purity because of misalignment of the beam landing positions. The magnitude of this mislanding caused by thermal expansion of a shadow mask varies considerably depending on the image pattern on the screen and the length of time this pattern continues.

Mislanding caused by heating effects extending from the shadow mask to the mask frame which supports the shadow mask, and which possesses a large heat capacity, requires a comparatively long time and an effective method of compensating this is to include bimetal in the spring support structure mounted on the mask frame, as disclosed in Japanese Patent Publication No. 44-3547. However, mislanding that is brought about in a comparatively short time, e.g., local mislanding due to local doming caused by very bright local displays, is a considerable problem.

In connection with mislanding that occurs in a short time, if use is made of a signal unit for generating rectangular window shaped patterns and the magnitude of mislanding is measured for different shapes and positions of the window-shaped patterns, it is found that mislanding is comparatively small when there is a large-current beam pattern 5 over practically the entire surface of the screen 6 as shown in FIG. 8 and that the greatest mislanding occurs when there is a large current beam raster pattern 5 that is comparatively long and narrow and is displayed slightly towards the center from the left or right-hand edge of the screen 6 periphery as shown in FIG. 9. This can be understood from the following reasons.

Firstly, since a TV receiver is designed so that the cathode ray tube's average anode current will not exceed a set value, the current per unit area of the shadow mask is smaller with a large window-shaped pattern as in FIG. 8 than it is in the case of FIG. 9 and so the temperature rise is small.

Secondly, if a pattern is in the middle of the screen, it is difficult for mislanding to occur even if the shadow mask is thermally deformed, but the degree to which thermal deformation of the shadow mask appears as mislanding on the screen becomes greater as the pattern moves from the center towards the left or right-hand edges. However, actual deformation near the left and right-hand edges of the screen is small, since the shadow mask is fixed to the mask frame in these locations. Thus, the greatest mislanding occurs in the case of window-shaped patterns in a position like that shown in FIG. 9.

FIG. 10 is a drawing for the purpose of explaining the form mislanding takes in the case of a pattern such as shown in FIG. 9. A shadow mask 136 is held in a facing relation to the inner surface wall of a panel 124 by a mask frame 134 making use of stud pins 125 and spring support structures 135. During operation at low luminance, i.e., when the electron current density is small, the shadow mask 136 is in position $a_1$ and an electron beam 142 at position $c_1$ passes through an aperture 137 and lands correctly on a corresponding phosphor dot 130. On a change from this state to display of a pattern with high local luminance such as shown in FIG. 9, local heating and expansion of the shadow mask 136 occurs, so resulting indisplacement of the shadow mask to position $a_2$ and displacement of the aperture 137 from position $b_1$ to $b_2$, in consequence of which the electron beam 142 that passes through the aperture 137 shifts from position $c_1$ to $c_2$ and there is no longer accurate landing on the set phosphor dot.

There is a procedure employed for preventing this short time thermal deformation of the shadow mask, which is to make the portions where the shadow mask is fixed to the mask frame as flexible as possible so that instead of there being doming deformation indicated by the dashed line 136*a* in FIG. 11(*a*) the shadow mask 136 as a whole moves parallel to the tube axis as indicated by the dashed line 136*b* in FIG. 11(*b*). However, although such a measure is effective against displacement caused by thermal expansion of the whole surface of the mask as in FIG. 11(*a*) or (*b*), it is of practically no effect against local displacement such as occurs in the case shown in FIG. 9. This trend becomes more marked as tubes are larger and have larger screens. Also, for a given size, it is more marked as the shadow mask's radius of curvature is larger, i.e., as the tube is flatter, which is considered preferably for visual perception.

SUMMARY OF THE INVENTION

An object of the present invention is to provide a new shadow mask curved shape to suppress the color purity degradation caused by the local thermal expansion due to electron beam impingement.

The color cathode ray tube in the present invention comprises a rectangular curved panel having a phosphor screen formed in the inner surface with a central axis at the center of and going in a direction normal to the phosphor screen, and a shadow mask with a non-spherical curved surface, the mask mounted through a substantially rectangular frame in a position such that the central axis passes through the mask center and possesses an effective area having formed therein a large number of apertures permitting passage of electron beams. Taking the mask center of the shadow mask as a point of origin, its major axis as the X axis, its minor axis as the Y axis and the central axis as the Z axis, that area in the effective area which is in the vicinity of the intersection of the plane containing the X and Z axis (X-Z plane) and the effective area is so shaped that minimal values of the radius of curved lines of intersection defined by the effective area and arbitrary planes that are parallel to the Y axis and the Z axis (Y-Z parallel planes) exist along the X axis between the mask center and the edges of the effective area.

Further, the curve of the line of intersection defined by the X-Z plane and the effective area in the mask is formed by the curve positioned to be close to the panel side against the circular are at least except that both the curve and the are pass substantially in common through both terminal points of the curve and the central point of the shadow mask. This curve should be, for example, the noncircular curve to strengthen partially the degree of curvature or the ellipse. The lines of intersection defined by the Y-Z parallel plane and the effective area of the mask may be the circular are, i.e., the partial circle, as well the noncircular curve.

According to an aspect of this invention, the line of intersection defined by the X-Z plane and the effective area is determined as noncircular curve, the line of intersection by upper and lower edges along with the long axis of effective are face and arbitrary planes parallel to the X and Z axis (X-Z parallel plane) as circular are, and the line of intersection by the Y-Z parallel plane and the effective area as circular are.

Further, the curved configuration or shape in the panel inner surface to form the screen may have the minimal values in the position corresponding to the minimal values of the shadow mask to the radius of curvature of the line of intersection with the Y-Z parallel plane similarly in accordance with the configuration of the shadow mask.

DETAILED DESCRIPTION OF PREFERRED EMBODIMENTS

Figure 1:
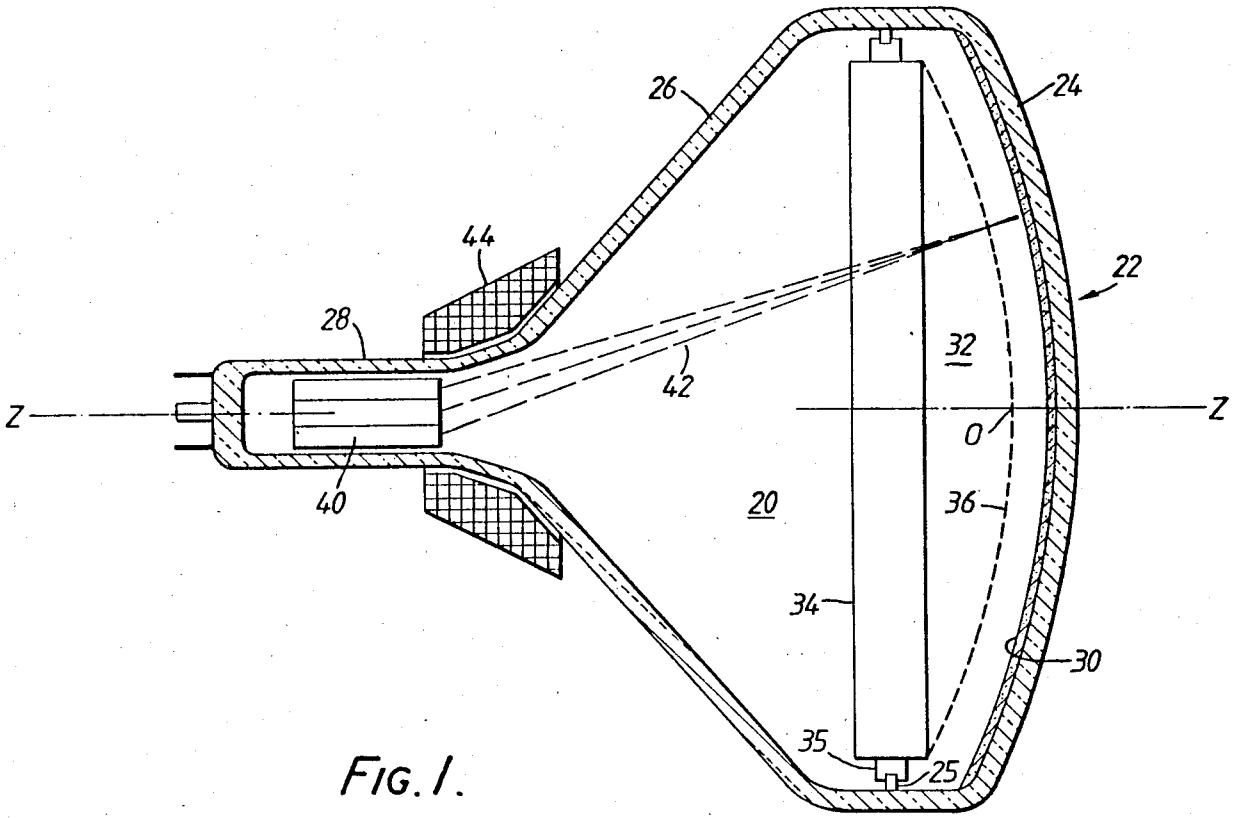
FIG. 1 is a longitudinal sectional view of an embodiment in the present invention.
Figure 2:
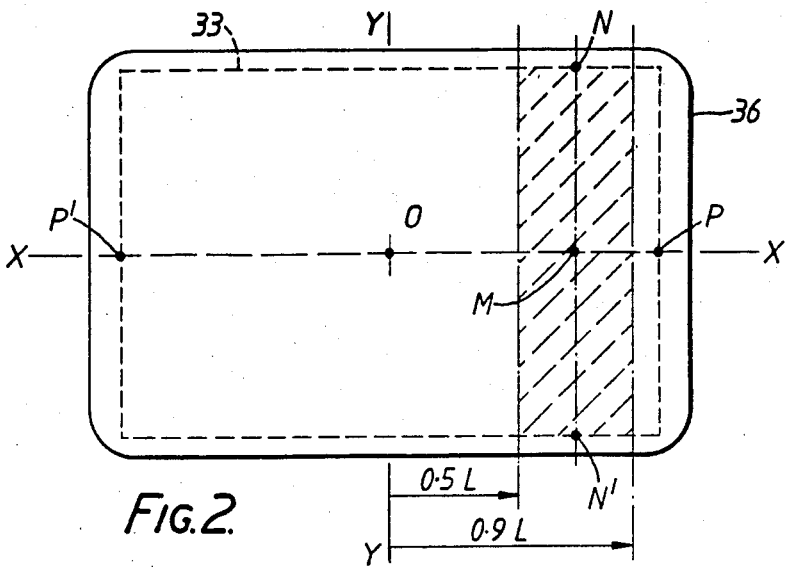
FIG. 2 is a schematic plan view of the shadow mask seen from the panel side in FIG. 1.

Referring to FIG. 1, a color cathode ray tube 20 constituting an embodiment of the invention has a glass envelope 22 comprising an approximately rectangular panel 24, a funnel 26 and a neck portion 28. The inner surface of panel 24 forms a spherically curved depressed surface on which is provided a phosphor screen 30 with phosphor dots of three colors, i.e., red, green and blue, arranged on it in a regular array. These phosphor dots constitute alternately disposed stripes of phosphors that emit red, green and blue. Normally, the direction of stripes is the vertical direction as seen in FIG. 2, i.e., the direction of the minor axis Y. A shadow mask structure 32 is mounted adjacent to screen 30. Shadow mask structure 32 consists of a rectangular frame 34 and a shadow mask 36 that has a large number of apertures formed in it and is elastically mounted by spring support elements 35 on stud pins 25 embedded in the skirt portion of panel 24. The apertures are formed in slits going in the direction of the Y axis in correspondence to the strips of the phosphor screen and define a rectangular effective area 33 indicated by the dashed line in FIG. 2 which constitutes the effective area for image display.

In-line type electron guns 40 are mounted in neck portion 28 and emit three electron beams 42 which pass through the apertures of shadow mask 36 and strike the phosphor screen 30. These electron beams 42 are deflected by a deflection yoke 44 mounted on the outside wall of funnel 26 and scan shadow mask 32 and phosphor screen 30.

Figure 3:
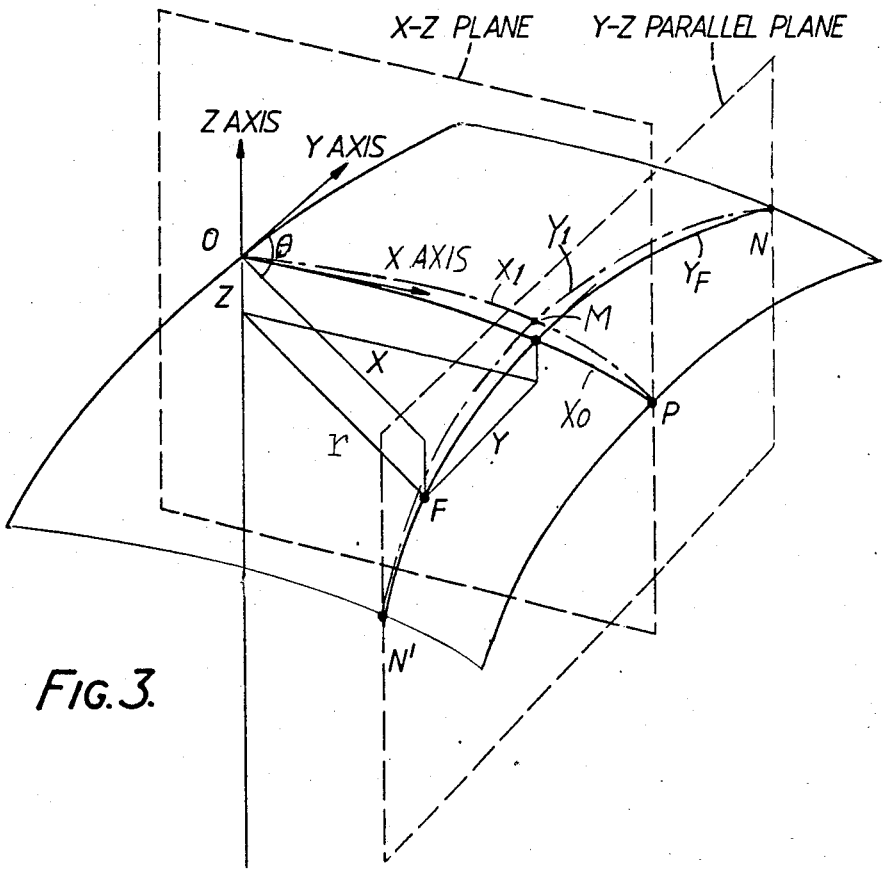
FIG. 3 is a perspective view of half the effective area of the shadow mask, which explains the configuration of the shadow mask in FIG. 2.

Taking the tube axis, i.e., the central axis Z that is normal to the screen at the center of screen 30, as shadow mask 36 is mounted in a position such that this Z axis pauses normally through the shadow mask center O. As shown in FIGS. 2 and 3, the rectangular shadow mask's major axis going horizontally is designated as the X axis, the minor axis going vertically as the Y axis and the mask center O as the point of origin.

In FIG. 3, the distance components along the respective X, Y and Z axes from the center O of shadow mask 36 to a point F on mask 35 are designated as X, Y and Z. If the radius of curvature at point F of the line of intersection formed by a plane that passes through point F from the Z axis cutting shadow mask 36 is designated as R, from conventional partial spherical surfaces, to optimize the q value it is simply necessary to make the shape of the curved surface a shape representable by $$Z = -\{R - \sqrt{R^2 - r^2}\} \quad (1)$$

$$R = A + B\cos 2\theta + C\cos 4\theta$$

-continued $r^2 = X^2 + Y^2$ or $$Z = -\{R_H - \sqrt{R_H^2 - X^2} + (R_{V0} + kX^2) - \sqrt{(R_{V0} + kX^2)^2 - Y^2}\} \quad (2)$$

etc., where $\theta$: angle with respect to Y axis $R_H$: radius of arc on major axis $R_{VO}$: radius of arc on minor axis A,B,C,k: constants r: distance from Z axis In the shadow mask of configuration as mentioned above, in the case of the equation (1), the arbitrary cross section of the effective area of the shadow mask by the parallelism passing through the Z axis becomes a circular arc. In the equation (2), the line of intersection $X_O$ by the effective area face and the X-Z plane, and the lines of intersection $Y_F$ by the effective area and the Y-Z parallel plane are expressed by a circular arc.

Figure 5:
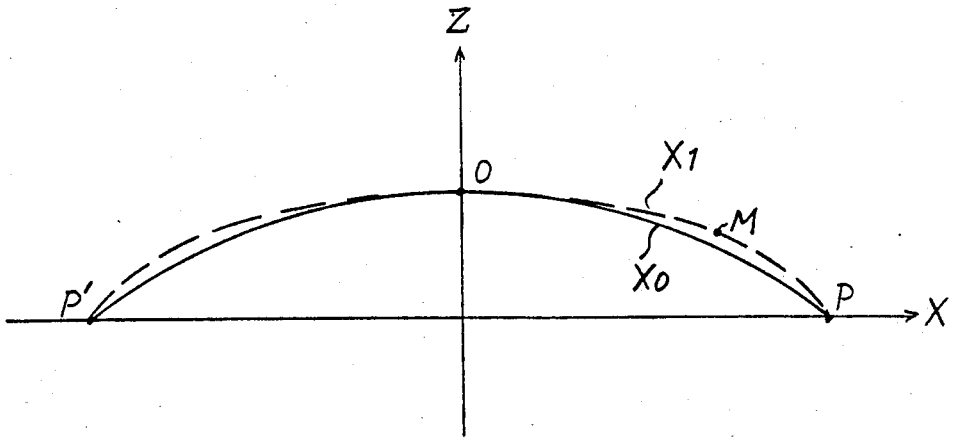
FIG. 5 is a curved view showing the configuration of the shadow mask in FIG. 4 with the line of intersection between the Y-Z parallel plane and the effective area of the shadow mask.

Then, in this embodiment, the line of intersection $X_1$ between the X-Z plane and the effective area is formed so as to depict a partial elliptic curve. That is, the partial ellipsoid making the center of the shadow mask 0 as vertex of the elliptic short minor axis is formed. Therefore, though in the vicinity of the center O the radius of curvature of the line of intersection is gentle, it becomes quickly small toward the X axis terminal points P and P' on the edges of the effective area. In FIG. 5 the symbol $X_0$ indicates the circular arc of the line of intersection defined by the X-Z plane and the effective area of the conventional shadow mask expressed by the equation (2), and this circular arc $X_0$ passes through three points of the central point 0 of the shadow mask and both terminal points P and P' of the effective area of the mask in the X axial direction. Against this the same line of intersection of the effective area of the shadow mask in this embodiment, as indicated by the symbol $X_1$, passes through three points of the central point 0 and the effective area terminal points P and P', and the remainder other than these points is formed by the nearer curve to the panel, expanding to the panel side.

This curve becomes the elliptic curve expressed by the following:

$$X^2/R_a^2 + Z^2/R_b^2 = 1 \quad (3)$$

Where $R_a$: Radius of the major axis of an ellipse $R_b$: Radius of the minor axis of an ellipse. As the curve $X_1$ in FIG. 5 obtained from this equation (3), the curvature changes largely near the point M at the P or P' side rather than the intermediate point between the distances OP and OP' of the line of intersection.

Figure 6:
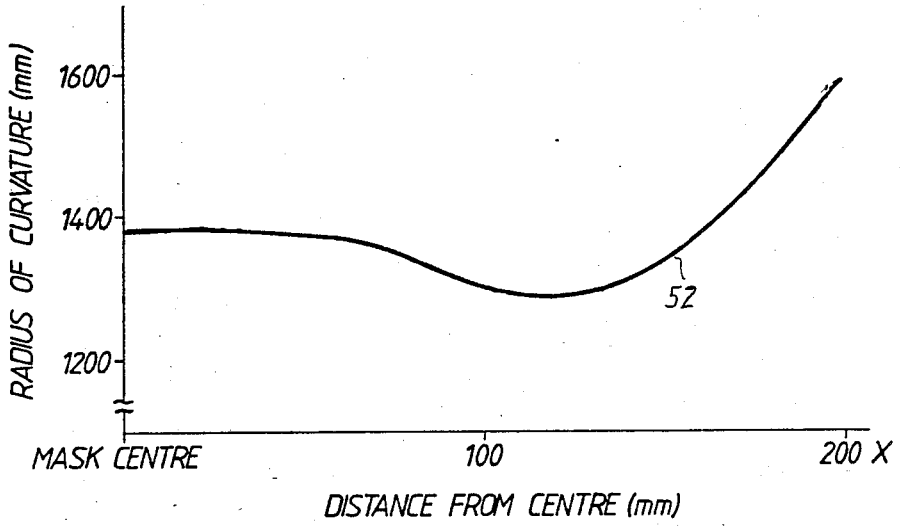
FIG. 6 is a curved view showing along with the radius of curvature with the line of intersection between the Y-Z parallel plane of the shadow mask and the effective area, which explains the present invention.
Figure 8:
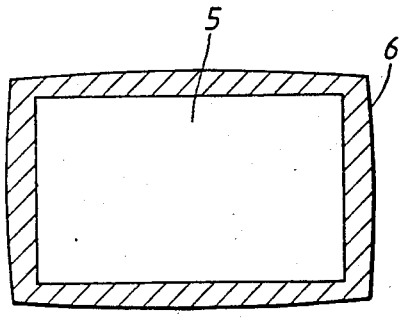
FIG. 8 is a sketch plan view to show a display pattern on the color cathode ray tube screen.

FIG. 6 shows a curve that the radius of curvature of the line of intersection $Y_1$ defined by the Y-Z parallel plane and the effective area changes along with the X axis, and accompanied by the change in the radius of curvature of the $X_1$. The more the radius of curvature of the circular arc of this Y-Z parallel plane intersection comes near to the terminal point P from the central point 0, the more it becomes smaller, and becomes larger again near the point P.

Figure 4:
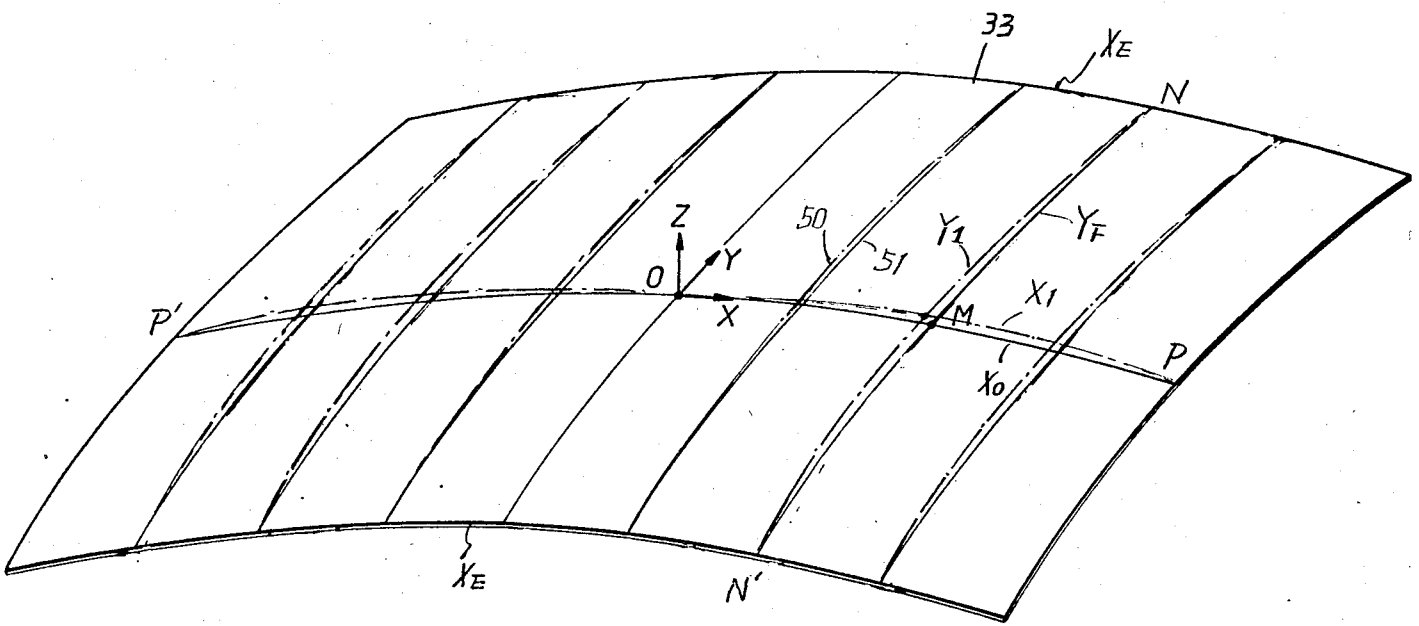
FIG. 4 is a perspective view showing the configuration of the shadow mask in FIG. 2 and the configuration of the conventional shadow mask in contrast.

FIG. 4 shows with broken lines 50, the configuration of the effective area 33 of the shadow mask in this embodiment, contrasting with the configuration of the conventional shadow mask by the abovementioned equation (2) shown with solid lines 51. In the conventional structure, the line of intersection $X_0$ defined by the X-Z plane and the effective area of the shadow mask is a circular arc, however, in this embodiment, these three points should be common against the circular are $X_0$ passing through three points of the center of the mask 0 and the effective area terminal points P and P' in the X axial direction, and the other part of the line among those three points becomes the configuration expressed by the curve $X_1$ passing through the position apart from the central point of radius of the circular arc, so as to expand towards the panel side. Therefore, the position of the intermediate point M along with the X axis of the shadow mask is of structure nearer to the panel than the circular are $X_0$. With this, the difference of the distance in the Z axial direction among the intermediate point M on the X axis and its upper and lower effective ends N and N' can be more largely taken, and the radius of curvature of the line of intersection $Y_1$ of the mask in the embodiment in the vicinity of the point M becomes smaller than the line of intersection $Y_F$ similarly to the conventional mask 51. On the one hand, the radii of curvature at the edges of the effective area in the directions of the X and Y axis are invariable. For this reason, the radius of curvature near the X-Z plane of the line of intersection $Y_1$ can take easier the minimal value at the intermediate point M on the X axis as shown in the curve 52 of FIG. 6. Consequently, it is possible to compensate more effectively the local mislanding by the thermal expansion of the shadow mask.

In this case, if the configuration of the long-edge side cross section $X_E$ of the effective area 33 of the shadow mask changes similarly to the configuration $X_0$ of the effective area 33 on the X axis, the distance in the Z axial direction among the intermediate point M and their upper and lower effective area ends N and N' does not relatively change, resulting in no effect of the mislanding prevention. Therefore, at least the configuration of the long-edge side cross section $X_E$ of the effective area 33 of the shadow mask, as shown in FIG. 4, may be enough to remain the radius of curvature substantially in agreement with this circular arc $X_0$, against the circular arc passing through three points of both terminal points and the central point of this cross section $X_E$.

Likewise, in the above case, the cross section configuration in the diagonally axial direction of the effective area 33 of the shadow mask becomes the curve passing through the panel side of this circular arc, except for the above mentioned three points, against the circular are passing three points of both terminal points and the central point, similarly to the configuration of the line of intersection $X_1$ on the X-Z plane. Consequently the mask face configuration also becomes a gentle change, and the press process at manufacture is facilitated.

Figure 9:
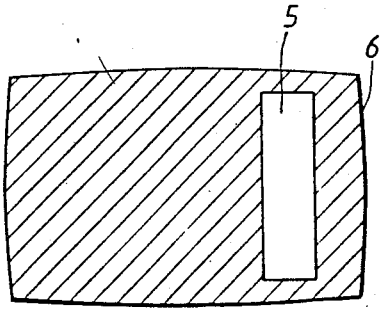
FIG. 9 is a sketch plan view to show another display pattern on the color cathode ray tube screen.
Figure 10:
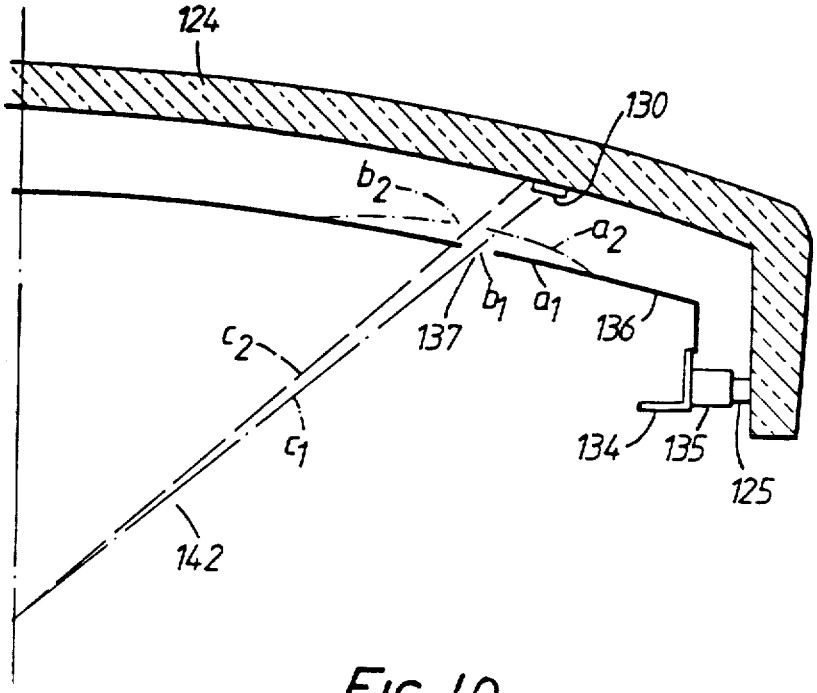
FIG. 10 is a sketch for explaining the local thermal deformation of the shadow mask produced in displaying pattern in FIG. 9.

The operation of this structure is explained in more detail referring to FIGS. 9 and 10.

In case a biased raster pattern as shown in FIG. 9 is displayed, only the area of the shadow mask 136 where the electron beams impinge as shown in FIG. 10, for initial 2 to 3 minutes, are thermally expanded, and the local mislanding occurs. If the temperature rise in the raster pattern area of the shadow mask 136 is measured at this time, in condition in which point M on the X axis at the center rises to about 70° C., the temperature rises about 25° C. at the points N and N', shown in FIG. 2, of the upper and lower effective area edges, i.e., at the opposite ends on the Y-Z parallel plane of raster patterns.

From this, it is found that the thermal expansion on and close to the X axis even in the area 5 is larger than the thermal expansion in the section apart from the X axis. In other words, the more the thermal deformation in the vicinity of the X axis is made smaller, the more thermal deformation of the whole raster pattern area 5 can be made smaller. Therefore, in the shadow mask of the embodiment in the present invention as shown in FIG. 1 to FIG. 4, while the local thermal expansion goes to the position largely affected to the deviation of the beam landing, i.e., to the terminal point P of the effective area along with the X axial direction from the center of the mask 0, the radius of curvature of the continuous intersection line $Y_1$ defined by the Y-Z parallel plane and the effective area is made smaller compared with the center of the mask 0. And, when the curved shape of the shadow mask is smoothly joined, the radius of curvature on the Y-Z parallel plane in the vicinity of the X axis of the shadow mask has the minimal value at the intermediate point M of the X axis.

Then, in the distance from the center of the mask 0 to the terminal point P in the ½ plane of the effective area of the mask as shown in FIG. 2, when the distance length is taken as L, in the range of the position from 0.5 L to 0.9 L from the central point 0, preferably 0.6 L to 0.8 L, the vicinity of the intermediate point near to the X axis (hatched line area) is the greatest mislanding area by the thermal expansion. Due to the fact that the radius of curvature on the Y-Z parallel plane gives a large effect to the thermal deiormation of the shadow mask and the more the radius of curvature is smaller the more the local mislanding is made smaller, a large compensative effect can be taken at the greatest mislanding point. Therefore, by this embodiment the local mislanding by the thermal expansion can be suppressed very effectively. For example, in a 21-inch, 90° deflecting type color cathode ray tube, while the radius of curvature on the X axis in the form expressed conventionally by the equation (2) is $R_H$=circular arc of 1,008 mm, in case it was made as $R_a$=241.66 mm and $R_b$=46.53 mm in the elliptic curve in the equation (3), the local mislanding can be improved 20% compared with the case in the equation (2). Though the eccentricity e of the above-mentioned elliptic curve is 0.98, it is desirable that the eccentricity in the application of the present invention be made to an ellipse of $0.5>e<1$.

Figure 7:
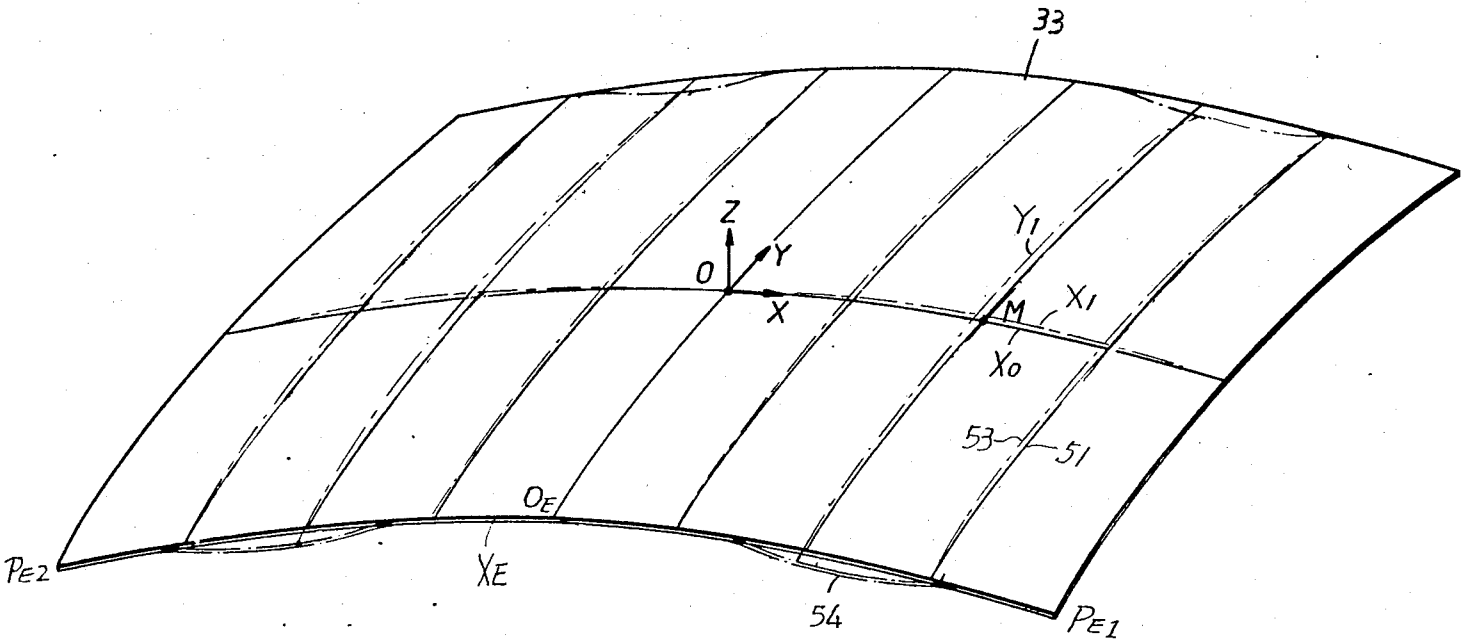
FIG. 7 is a perspective view showing the configuration of the shadow mask of another embodiment of the present invention in contrast with the conventional shadow mask.

FIG. 7 shows another embodiment in this invention. And, the part of the same symbol as FIG. 4 indicates the similar part. In the embodiment previously described, the line of intersection $X_1$ by the X-Z plane and the effective area 33 of the mask is made partially elliptic, and the curve of both opposite edges in the Y axial direction of the effective area are made a circular arc. As compared with the shape, in the shadow mask 53 of this embodiment, the shape of buckled portion 54 of the noncircular curve depressed against the screen is formed to a part of both end edges containing N,N' of the effective area in the Y axial direction as shown in the figure. This expands easily the setting range to the radius of curvature of the line of intersection $Y_1$ on the Y-Z parallel plane in the distinguished position of the beam landing by the thermal expansion. However, if buckled portion 54 is made too large, the press of the shadow mask is difficult to be made. Further, since inconvenience that the configuration of the raster on the screen distorts, it is convenient to design the buckled portion 54 to the narrow range. On the other hand, in case the value q is deviated from the optimal value by means of this buckled portion, it can be solved by forming the inner surface configuration of the panel to the configuration of the mask similar. The change of the raster distortion characteristics caused as its result does not make an issue practically, as the amount of distortion is small.

The optimum permissible range of the deviation amount of the buckled portion 54 contained in the line of the effective area edge $X_E$ in the Y axial direction, i.e., the line of intersection defined by the effective area edge and the X-Z parallel plane parallel to the X and Z axis, with three points of the terminal points $P_{E1}$,$P_{E2}$ and the center point $O_E$ is −0.0031 s mm, against the circular are passing through these three points, when taking the diagonal length of the rectangular effective area of the shadow mask as s mm and taking the panel side as + (plus) direction in the Z axis direction.

In the 21 inch type color cathode ray tube, the value s becomes 485 mm, the deviation being approximately −1.5 mm. And, similarly, it is practical to limit the distance in the Z axial direction in the arc of $X_E$ of the shadow mask of the first embodiment to the adjustment range of less than +0.3 mm.

Alternatively, the line of intersection between the X-Z plane and the effective area of the shadow mask can be formed by the noncircular curve other than the ellipse. In this case, it is possible to select the multiple curve and composite elliptic curve easily enabling to minimize the radius of curvature of the line of intersection of the Y-Z parallel plane in the vicinity of the area where the beam and mislanding are made greater. This curve is also required to be the curve passing through the points slightly deviating to the panel side than the circular are other than three points of the terminal points P and P' in the X axial direction and the central point O, through which the curve and the circular are passes in common.

According to the present invention as mentioned above, the deterioration of the color purity by the local thermal deformation of the shadow mask can be effectively suppressed, only by changing partially the curved configuration, without changing sharply the structure of the shadow mask or the panel. In addition, it facilitates forming the shadow mask without causing inconvenience on production.

What is claimed is:

1. A color cathode ray tube comprising:

a substantially rectangular curved panel having an inner surface on which is formed a phosphor screen, said panel having a central axis normal to said screen at the center of said panel;

a shadow mask having a center and a non-spherical curved surface and which is mounted via a substantially rectangular frame in a position such that the central axis of said panel passes through the center of the mask, said shadow mask having an effective area in which a plurality of apertures are formed to permit passage of electron beams through said apertures; and said shadow mask having a major axis, a minor axis, opposed short edges and opposed long edges, said mask defining a three dimensional cartesian geometry in which the mask center is the origin, the major axis is the X axis, the minor axis is the Y axis, and an axis normal to the mask at the mask center is the Z axis, said mask having a first line of intersection formed between the opposed short edges by the intersection of a plane containing the X and Z axes (X-Z plane) and the effective area of the mask, said mask having second lines of intersection formed by intersections of parallel planes that are parallel to the Y and Z axes (Y-Z parallel planes) and the effective area, said second lines of intersection having varying values of radii of curvature along the first line of intersection with minimum radii of curvature occuring between the center of the mask and the opposed short edges of the mask, said second lines of intersection terminating at the opposed long edges of the mask, said long edges of the mask each having a cross section which defines a substantially circular arc.

2. A color cathode ray tube claimed in claim 1, wherein the first line of intersection forms a part of an elliptic curve substantially taking a line parallel to the X axis as its major axis and a line parallel to the z axis as its minor axis.

3. A color cathode ray tube claimed in claim 1, wherein the first line of intersection defines a noncircular curve.

4. A color cathode ray tube comprising:

a substantially rectangular curved panel having an inner surface on which is formed a phosphor screen, said panel having a central axis normal to said screen at the center of said panel;

a shadow mask having a center and a non-spherical curved surface and which is mounted via a substantially rectangular frame in a position such that the central axis of said panel passes through the center of the mask, said shadow mask having an effective area in which a plurality of apertures are formed to permit passage of electron beams through said apertures; and said shadow mask having a major axis, a minor axis, opposed short edges and opposed long edges, said mask defining a three dimensional cartesian geometry in which the mask center is the origin, the major axis is the X axis, the minor axis is the Y axis, and an axis normal to the mask at the mask center is the Z axis, said mask having a first line of intersection formed between the opposed short edges by the intersection of a plane containing the X and Z axes (X-Z plane) and the effective area of the mask, said mask having second lines of intersection formed by intersections of parallel planes that are parallel to the Y and Z axes (Y-Z parallel planes) and the effective area, said second lines of intersection having varying values of radii of curvature along the first line of intersection with minimum radii of curvature occurring between the center of the mask and the opposed short edges of the mask, said second lines of intersection terminating at the opposed long edges of the mask, said long edges of the mask each having a cross section which defines a substantially circular arc having buckled portions which occur at at least those second lines of intersection having said minimum values of radii of curvature.

5. A color cathode ray tube according to claim 4, wherein the distance between each buckled portion and an imaginary circular arc passing through the end points of the respective long edge and the terminal point at the respective long edge of the second line of intersection passing through the center of the mask varies from $-0.0031s$ min to $+0.3$ mm, in which the panel side of the mask is defined as the + (plus) direction in the Z axis direction and the diagonal length of the rectangular effective area of the shadow mask is defined as s mm.

6. A color cathode ray tube claimed in claim 4, wherein the first line of intersection forms a part of an elliptic curve substantially taking a line parallel to the X axis as its major axis and a line parallel to the z axis as its minor axis.

7. A color cathode ray tube claimed in claim 4, wherein the first line of intersection defines a noncircular curve.

* * * * *

UNITED STATES PATENT AND TRADEMARK OFFICE

CERTIFICATE OF CORRECTION

PATENT NO. : 4,697,119

DATED : September 29, 1987

INVENTOR(S) : Masatsugu Inoue, et al

Figure 11:
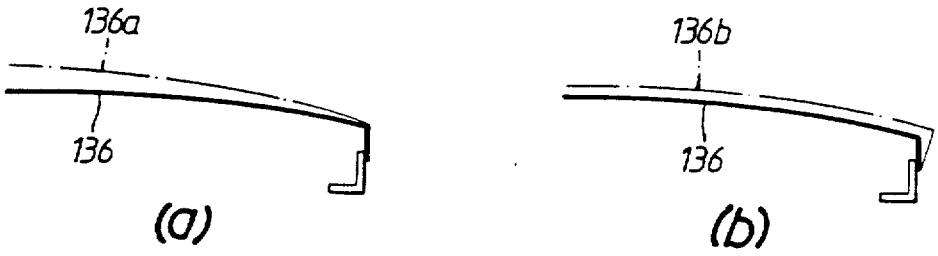
FIG. 11 is a drawing showing the type (a) and type (b), which explains the thermal deformation on the whole surface of the shadow mask.

It is certified that error appears in the above-identified patent and that said Letters Patent is hereby corrected as shown below:

Insert Figs. 10 and 11 as part of Letters Patent as shown on the attached sheet.

Signed and Sealed this

Fifteenth Day of March, 1988

*Attest:*

*Attesting Officer*

DONALD J. QUIGG

*Commissioner of Patents and Trademarks*